US009455109B2

(12) United States Patent
Dürr et al.

(10) Patent No.: US 9,455,109 B2
(45) Date of Patent: Sep. 27, 2016

(54) OVERLOAD RELEASE, IN PARTICULAR FOR A CIRCUIT BREAKER

(75) Inventors: Andreas Dürr, Amberg (DE); Xaver Laumer, Schorndorf (DE); Bernhard Rösch, Sulzbach-Rosenberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 346 days.

(21) Appl. No.: 14/122,745

(22) PCT Filed: Jun. 20, 2012

(86) PCT No.: PCT/EP2012/061867

§ 371 (c)(1),
(2), (4) Date: Nov. 27, 2013

(87) PCT Pub. No.: WO2013/004503

PCT Pub. Date: Jan. 10, 2013

(65) Prior Publication Data

US 2014/0091894 A1 Apr. 3, 2014

(30) Foreign Application Priority Data

Jul. 5, 2011 (DE) ..... 10 2011 078 636

(51) Int. Cl.

| | |
|---|---|
| ***H01H 71/16*** | (2006.01) |
| ***H01H 37/52*** | (2006.01) |
| ***H01H 37/34*** | (2006.01) |

(52) U.S. Cl.

CPC ..... *H01H 71/164* (2013.01); *H01H 37/34* (2013.01); *H01H 37/52* (2013.01); *H01H 71/16* (2013.01); *H01H 2037/525* (2013.01); *H01H 2037/526* (2013.01); *H01H 2037/528* (2013.01)

(58) Field of Classification Search

CPC .... H01H 71/16; H01H 71/164; H01H 37/52; H01H 37/34; H01H 2037/525; H01H 2037/526; H01H 2037/528

USPC ..... 337/102

See application file for complete search history.

(56) References Cited

U.S. PATENT DOCUMENTS 2,088,443 A * 7/1937 Schaefer ..... H01H 71/161 337/102
2,833,889 A * 5/1958 Boddy ..... H01H 37/52 337/107

(Continued)

FOREIGN PATENT DOCUMENTS

AU 2009222585 4/2010
CN 87214600 U 4/1988

(Continued)

OTHER PUBLICATIONS

International Search Report PCT/ISA/210 for PCT/EP2012/061867 dated Oct. 18, 2012.

(Continued)

*Primary Examiner* — Anatoly Vortman
(74) *Attorney, Agent, or Firm* — Harness, Dickey & Pierce, P.L.C.

(57) ABSTRACT

An overload release is disclosed, in particular for a circuit breaker, including a metal strip which is made of at least two different types of metal and around which a heat conductor is wound. In an embodiment, the mechanical and electrical connection of the metal strip can be completely or partly disconnected, such that no current flows over the mechanical connection of the metal strip in the completely disconnected case and a portion of the current flows over the mechanical connection in the partly disconnected case.

13 Claims, 5 Drawing Sheets

(56) References Cited

U.S. PATENT DOCUMENTS

| | | | | |
|---|---|---|---|---|
| 2,897,319 | A * | 7/1959 | Wolff | H01H 71/10 337/102 |
| 3,226,510 | A * | 12/1965 | Thomas | H01H 50/20 337/102 |
| 3,562,688 | A * | 2/1971 | Kussy | H01H 71/7436 337/102 |
| 4,788,518 | A * | 11/1988 | Sako | H01H 83/223 337/45 |
| 5,831,509 | A * | 11/1998 | Elms | H01H 71/125 335/35 |
| 2004/0065536 | A1 | 4/2004 | Takiagwa | |
| 2004/0085702 | A1* | 5/2004 | Ohkubo | H01H 83/223 361/161 |
| 2007/0252671 | A1* | 11/2007 | Bischoff | H01H 37/5427 337/365 |
| 2011/0025449 | A1* | 2/2011 | Grosskopf | H01H 37/5418 337/365 |
| 2013/0009743 | A1* | 1/2013 | Rosch | H01H 71/0207 337/3 |

FOREIGN PATENT DOCUMENTS

| | | | |
|---|---|---|---|
| CN | 201364863 | Y | 12/2009 |
| CN | 101728128 | A | 6/2010 |
| CN | 201845719 | U | 5/2011 |
| DE | 1149803 | B | 6/1963 |
| DE | 1513282 | A1 | 12/1969 |
| DE | 2802851 | A1 | 7/1979 |
| DE | 2818203 | A1 | 11/1979 |
| JP | 8153451 | A | 6/1996 |
| JP | 2000351078 | A | 12/2000 |

OTHER PUBLICATIONS

1 Chinese Office Action and English translation thereof dated May 6, 2015.

* cited by examiner

OVERLOAD RELEASE, IN PARTICULAR FOR A CIRCUIT BREAKER

PRIORITY STATEMENT

This application is the national phase under 35 U.S.C. §371 of PCT International Application No. PCT/EP2012/061867 which has an International filing date of Jun. 20, 2012, which designated the United States of America and which claims priority to German patent application number DE 10 2011 078 636.8 filed Jul. 5, 2011, the entire contents of each of which are hereby incorporated herein by reference.

FIELD

At least one embodiment of the invention generally relates to an overload release, in particular for a circuit breaker, comprising a metal strip including at least two different types of metal, around which a heating conductor is wound.

BACKGROUND

The technical properties of motor or circuit protection devices resides inter alia in detecting the temperature by means of wound bimetallic elements which are arranged in the current-conducting feed lines of electrical consumers to be monitored.

In electromechanical protection devices, in particular in circuit breakers, bimetallic or trimetallic strips are used as overload releases. In order to achieve the desired tripping characteristics, the metal strips generally either have a heating winding or a heating stack.

Heating windings are metal wires or bands which are wound around the bimetallic strip. An electrical insulator, for example glass filament fabric, is located between the bimetallic strip and the heating winding in order to prevent a short circuit of the individual heating conductor windings with respect to the bimetallic strip. The heating conductor and the bimetallic element are welded to one another at the upper end of the bimetallic strip.

Accordingly, bimetallic strips are used in electromechanical protection devices. If current is flowing through the bimetallic strips, i.e. the bimetallic strips are heated directly, they need to be connected not only mechanically but also electrically in the device. These two connections are implemented by way of welding between the bimetallic strip and the metal part. The bimetallic strip is fixed in the device by way of this metal part. At the same time, the current is passed to the bimetallic strip via the metal part.

In devices for relatively high currents, problems related to device heating and manufacturing-related and device-related obstacles has been caused by virtue of the fact that copper-plated steel materials are used for the metal part. This material can be welded easily to the bimetallic strip under certain conditions. Owing to the steel content, the material is firstly ferromagnetic and can therefore be integrated in the magnetic circuit of a short-circuit release. Secondly, the steel content also provides the required rigidity for the metal part. The thickness of the copper plating is in this case selected such that the resistance of the metal part, and therefore heating of the metal part during operation of the device, is reduced to the required extent.

It is expedient in economic and technical terms to use copper-plated steel bands for producing the metal parts only up to a certain limit. A limitation in economic terms resides in the price of the material, which is approximately twice as high as that for pure copper bands with the same dimensions. An additional cost-increasing factor in this context resides in that the waste material from stamping as mixed metal scrap only brings in a small income. There therefore results the economic necessity to minimize, in design terms, the use of this material in the device and the amount of waste produced during stamping. A technical limitation is imposed on the use of the copper-plated steel material based on the current range of the devices with an upper limit such that the thickness of the copper plating also needs to increase as the current range increases.

At the same time, the total sheet thickness of the material should remain the same so that no separate manufacturing devices including stamping and bending tools, part feeds, installation apparatuses or welding receptacles are required. This means that the steel content in the material is reduced. Above a certain limit, this results in problems when connecting the metal part and the bimetallic strip. Furthermore the metal part loses some of its required rigidity for sufficient mechanical fixing of the bimetallic strip. In the case of devices with short-circuit releases, such as circuit breakers, for example, the low steel content in the metal part results in a reduced function in the magnetic circuit of the release coil.

SUMMARY

At least one embodiment of the present invention resides in providing an overload release which enables thermal economy in particular for relatively high current ranges.

At least one embodiment is directed to an overload release. Advantageous embodiments and developments which can be used individually or in combination with one another are described herein.

According to at least one embodiment of the invention, an overload release is disclosed, in particular for a circuit breaker, comprising a metal strip including at least two different types of metal, around which a heating conductor is wound. In this case, in at least one embodiment of the invention, the mechanical and electrical connection of the metal strip is completely or partially separated, with the result that, in the case of complete separation, no current flows via the mechanical connection of the metal strip and in the case of partial separation, some of the current flows via the mechanical connection.

BRIEF DESCRIPTION OF THE DRAWINGS

Further advantages and embodiments of the invention will be explained below with reference to example embodiments and with reference to the drawing in which, schematically.

DETAILED DESCRIPTION OF THE EXAMPLE EMBODIMENTS

Figure 1:
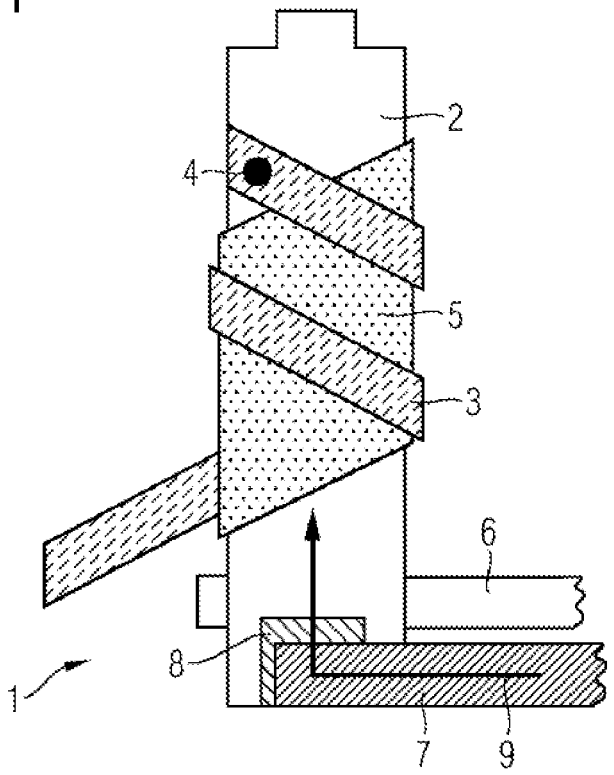
FIG. 1 shows a front view of an overload release comprising a metal strip with a heating conductor winding, in particular for a circuit breaker with a separate mechanical and electrical connection of the metal strip.

According to at least one embodiment of the invention, an overload release is disclosed, in particular for a circuit breaker, comprising a metal strip including at least two different types of metal, around which a heating conductor is wound. In this case, in at least one embodiment of the invention, the mechanical and electrical connection of the metal strip is completely or partially separated, with the result that, in the case of complete separation, no current flows via the mechanical connection of the metal strip and in the case of partial separation, some of the current flows via the mechanical connection.

The solution according to at least one embodiment of the invention therefore resides here in that the mechanical and electrical connection of the metal strip, in particular the bimetallic strip, are separated. As a result, firstly thermal economy can be achieved and secondly both manufacturing-related and device-related advantages can be achieved. According to at least one embodiment of the invention, the separation of the mechanical and electrical connection can be complete or partial. In the case of complete separation, no current flows via the mechanical connection of the bimetallic strip, and in the case of partial separation, some of the current flows via the mechanical connection. By virtue of the separation according to the invention of the two connections, the necessity for a compromise between mechanical and electrical requirements is eliminated. The respective connection can therefore be optimized.

The mechanical connection and therefore the fixing of the bimetallic strip in the device preferably takes place via one single steel part. The welding between the steel part and the bimetallic strip is possible in a simple manner owing to the material pairing. No current flows via the welding during operation of the device. The bimetallic strip is mechanically fixed precisely in the upper part of the circuit breaker via the steel part.

The electrical connection of the bimetallic strip is implemented directly in accordance with at least one embodiment of the invention, i.e. without any current being conducted via the metal part which connects the bimetallic strip mechanically. The current conduction in the current path of the switching device is generally performed via a copper conductor. This is connected directly to the bimetallic strip in accordance with the invention. Copper conductors with a small cross section can be welded directly to the bimetallic strip. Copper conductors with a large cross section cannot readily be welded to the bimetallic strip. Copper conductors with a large cross section can be soldered to the bimetallic strip under certain conditions. This can take place using a suitable flux and solder.

Another way of soldering the copper line to the bimetallic strip resides in initially producing at least partially a surface on the bimetallic strip which can be soldered with a solder which does not need to be reworked. There, the copper conductor can then be soldered. In order to produce such solderable surfaces on the bimetallic strip, various procedures are possible. In the case of trimetallic strips, a copper core is located in the interior, which copper core can be exposed; the surface of trimetallic strips can be refused up to the copper core; a suitable platelet can be welded on; or the surface of the bimetallic element can be copper-plated.

In the case of switching devices for relatively high current ranges, almost exclusively so-called trimetallic elements are used for producing the metal strip. These trimetallic elements have a copper core which is arranged between the active and the passive side. By partially removing the active or passive side, the copper core can be exposed, for example, by milling, broaching, grinding or other manufacturing processes. Thus, a copper surface is produced.

If the surface of the trimetallic element is refused to a sufficient extent, copper from the copper core is embedded in the active or passive side. As a result, copper is also located on the surface, with the result that soldering can be performed there. The refusing can take place, for example, by means of a laser jet.

With the aid of a platelet, likewise a solderable surface can be produced on the bimetallic strip. The platelet has the property that it can both be welded to the bimetallic strip and soldered to the copper conductor. In this case, the platelet can be made either from a homogeneous material, such as brass or bronze, or from a multilayered material such as copper-coated steel, for example. In the case of copper-coated steel, the platelet is welded with the steel side to the bimetallic strip. The copper conductor can be soldered or connected in another way on the outer copper-coated side.

By virtue of complete or partial copper-plating of the bimetallic element surface, a solderable surface can be produced. The copper plating can in this case be performed using various methods: it is possible for the initial material for the bimetallic strips to be copper-plated or to be electroplated with at least 10 μm of copper. It is also possible for the stamped bimetallic strips to be electroplated with at least 10 μm of copper prior to the winding process. It is also conceivable for the stamped bimetallic strips to be coated with at least 10 μm of copper prior to the winding process by means of so-called gas dynamic cold spray.

At least one embodiment of the present invention resides in separating the mechanical and electrical connection of the bimetallic strip in the switching device in bimetallic strips through which current is flowing. It is thus possible to connect a material with good conductivity to a bimetallic element directly. The metal part for the mechanical connection of the bimetallic strip can be optimized for its mechanical and magnetic functions. It can be in the form of an inexpensive steel component and therefore at the same time opens up the possibility of rigid fixing of the bimetallic element. This is significant from a device-technical point of view.

For the connection of bimetallic strips to the fixing steel component, the laser welding method which can easily be automated can be used, as a result of which the manufacturing costs are reduced. Since the connection does not conduct any current, less stringent demands are placed on the welded cross section. This has a positive effect in terms of manufacturing technology and economy. The virtually direct current conduction in the bimetallic strips without a further metal part interposed makes an important contribution to the minimization of the electrical resistance and therefore to the heating in the current path outside the bimetallic strip. This is significant in terms of device technology since, owing to the increasing power density desired by the customer in a switching device, the maintenance of the permissible heating represents a requirement of increasing the power density. The separation of the mechanical and electrical connection of the bimetallic switch in a switching device makes it possible to save on expensive copper-plated material. In addition, the electrical connection can be improved. Thus, relatively large welded current-carrying cross sections are produced, with the result that safety is increased in the case of short-circuit currents and overload currents.

FIG. 1 shows an overload release 1 according to an embodiment of the invention comprising a metal strip 2 and a heating conductor winding 3. The metal strip 2 is preferably in the form of a bimetallic strip and is connected to the heating conductor winding 3 via a welding 4. An insulating sleeve 5 is arranged between the metal strip 2 and the heating conductor winding 3. The metal strip 2 is fixed mechanically via a metal part 6. The connection of the metal strip 2 is formed electrically via a current conductor 7, in particular a copper conductor. The electrical connection can be formed via a welded-on platelet 8, for example. The current conduction 9 passes via the current conductor 7 and the welded-on platelet 8 into the metal strip 2.

Figure 2:
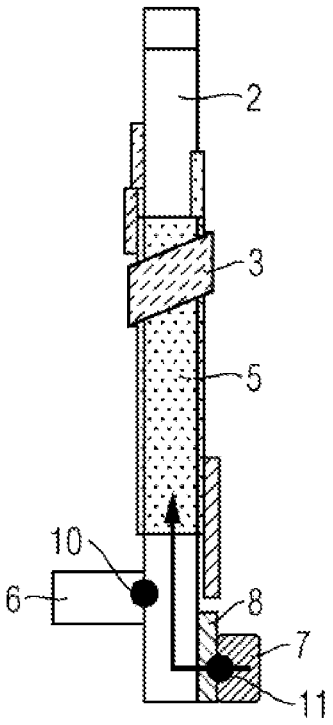
FIG. 2 shows a side view of the overload release shown in FIG. 1.

FIG. 2 illustrates the overload release 1 shown in FIG. 1 from the side. This illustration shows the connection points for the mechanical connection of the metal strip 2 to the metal part 6 by means of a welding 10 and the electrical connection via the welding or soldering 11 between the current conductor 7 and the welded-on platelet 8.

Figure 3:
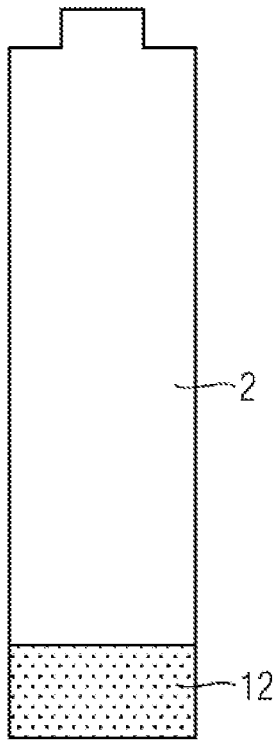
FIG. 3 shows a front view of a metal strip, in particular a trimetallic strip with an exposed copper core.

FIG. 3 illustrates a metal strip 2, in particular a trimetallic strip with an exposed copper core 12. In the case of switching devices for relatively high current ranges, almost exclusively so-called trimetallic elements are used for producing thermostatic metal strips. These trimetallic elements have a copper core, which is arranged between the active and the passive side of the trimetallic strip. By partially removing the active or passive side, the copper core can be exposed by milling, broaching, grinding or other manufacturing methods. A copper surface is thus produced.

Figure 4:
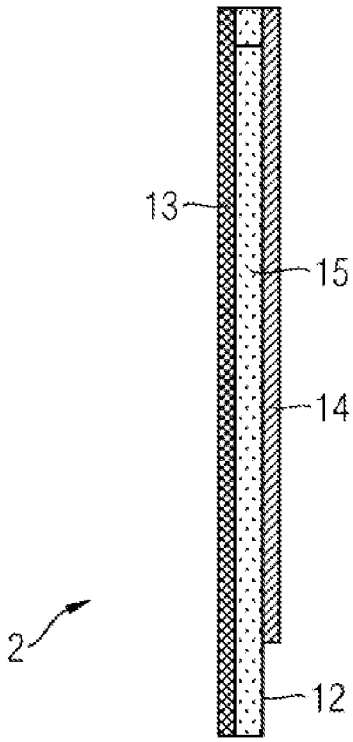
FIG. 4 shows a side view of the metal strip shown in FIG. 3.

FIG. 4 illustrates the metal strip 2 shown in FIG. 3 in a side view. FIG. 4 shows the metal strip 2 in an embodiment as a trimetallic strip. The trimetallic strip comprises a passive side 13, an active side 14 and a copper core 15, which is arranged between the passive side 13 and the active side 14. A point which is exposed by the active side 14 and which represents the exposed copper core 12 is located at one end of the trimetallic strip.

Figure 5:
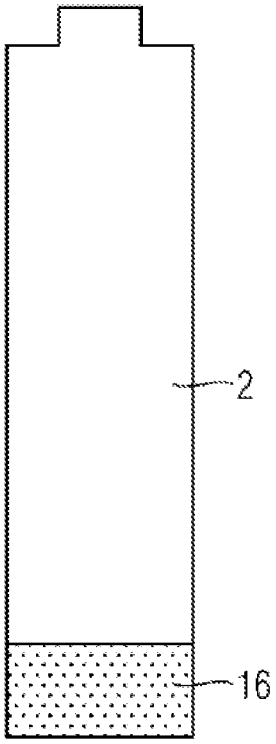
FIG. 5 shows a front view of a metal strip with a refused surface.

In FIG. 5, the metal strip 2 is likewise in the form of a trimetallic strip which has a refused surface 16 at one end. If the surface of the trimetallic element is refused to a sufficient extent, copper from the copper core 15 is embedded in the active side 14 or passive side 13. As a result, copper is also located on the surface, with the result that soldering can be performed there. The refusing can take place, for example, by way of a laser jet.

Figure 6:
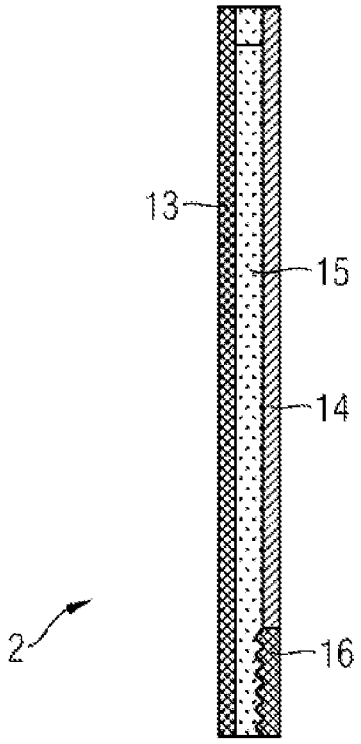
FIG. 6 shows a side view of the metal strip shown in FIG. 5.

FIG. 6 illustrates the metal strip 2 shown in FIG. 5 in a side view. The side view shows that the refusing of the surface of the trimetallic strip reaches into the copper core.

Figure 7:
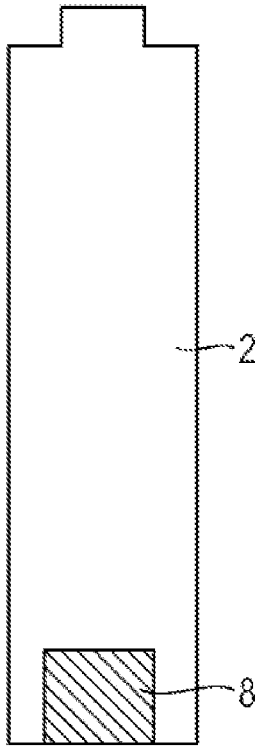
FIG. 7 shows a front view of a metal strip, in particular a bimetallic strip with a welded-on platelet of homogeneous material.

FIG. 7 shows a metal strip 2, in particular a bimetallic strip with a welded-on platelet 8. A solderable surface can be produced on the bimetallic strip with the aid of a platelet. The platelet has the property that it can both be welded to the bimetallic strip and soldered to the copper conductor. In this case, the platelet 8 can either be formed from a homogeneous material such as brass or bronze, for example, or consist of a multilayered material such as copper-coated steel, for example. In the case of copper-coated steel, the platelet 8 is welded with the steel side to the bimetallic strip. The copper conductor can be soldered or connected in another way on the outer copper-coated side.

Figure 8:
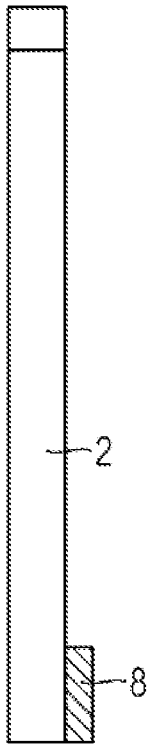
FIG. 8 shows a side view of the metal strip shown in FIG. 7.

FIG. 8 illustrates a side view of the example embodiment shown in FIG. 7 with a platelet including a homogeneous material.

Figure 9:
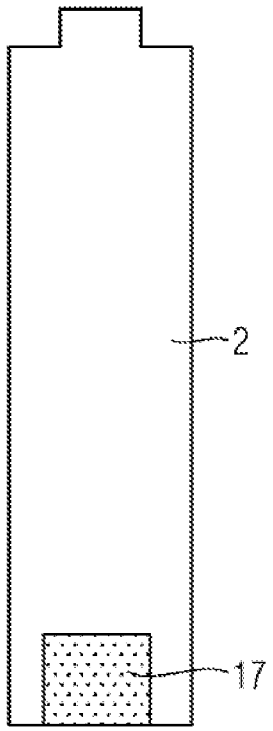
FIG. 9 shows a front view of a metal strip, in particular a bimetallic strip with a welded-on platelet including a multilayered material.
Figure 10:
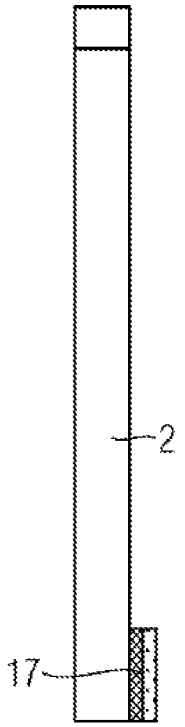
FIG. 10 shows a side view of the metal strip shown in FIG. 9.

FIG. 9 illustrates a metal strip 2, in particular a bimetallic strip with a welded-on platelet 17 including a multilayered material. The multilayered material can be, for example, copper-coated steel. In the case of copper-coated steel, the platelet is welded with the steel side to the bimetallic strip. The copper conductor can be soldered or connected in another way on the outer copper-coated side. FIG. 10 shows this embodiment in a side view.

An embodiment of the present invention resides in separating the mechanical and electrical connection of the bimetallic strip in the switching device in the case of bimetallic strips through which current is flowing. This makes it possible to connect a material with good conductivity directly to a bimetallic element. The metal part for the mechanical connection of the bimetallic strip can be optimized for its mechanical and magnetic functions. It can be in the form of an inexpensive steel component and therefore at the same time opens up the possibility of rigid fixing of the bimetallic element. This is of significance from a device-technical point of view.

For the connection of bimetallic strips to the fixing steel component, the easily automatable laser welding process can be used, as a result of which manufacturing costs are reduced. Since the connection does not conduct current, less stringent demands are made of the welded cross section. This has a positive effect in terms of manufacturing technology and economics. The virtually direct current conduction in the bimetallic strip without a further metal part interposed contributes to the minimization of the electrical resistance and therefore to the heating in the current path outside the bimetallic strip. This is of significance from a device-technical point of view since, owing to the increasing power density desired by the customer in a switching device, the maintenance of the permissible heating represents a requirement of increasing the power density. The separation of the mechanical and electrical connection of the bimetallic strip in the switching device makes it possible to save on expensive copper-plated material. In addition, the electrical connection can be improved. This results in relatively large welded current-carrying cross sections, with the result that safety is increased in the event of short-circuit currents and overload currents.

The invention claimed is:

1. An overload release, comprising:

a metal strip including at least two different types of metal, around which a heating conductor is wound, a non-conducting mechanical connection that connects the metal strip to a metal part of the overload release and a conducting electrical connection that connects the metal strip to a current conductor, the mechanical connection and the electrical connection of the metal strip being separated from one another, wherein no current may flow via the mechanical connection of the metal strip during operation of the overload release.

2. The overload release of claim 1, wherein the mechanical connection of the metal strip is a weld.

3. The overload release of claim 1, wherein the electrical connection is formed via the current conductor.

4. The overload release of claim 3, wherein the metal strip is a trimetallic strip with a copper core, arranged between an active and a passive side of the trimetallic strip, wherein the copper core is partially exposed.

5. The overload release of claim 3, wherein the metal strip in the form of a trimetallic strip includes or embeds copper from the copper core in the surface by virtue of the surface comprising the active or passive side being refused.

6. The overload release of claim 5, wherein the refusing is in the form of laser jet alloying.

7. The overload release of claim 3, wherein the metal strip is electrically connectable via both a weldable and a solderable platelet.

8. The overload release of claim 7, wherein the platelet is formed from brass or bronze or copper-coated steel.

9. The overload release of claim 3, wherein the metal strip includes a copper-plated surface.

10. The overload release of claim 1, wherein the overload release is for a circuit breaker.

11. The overload release of claim 10, wherein the metal strip is in the form of a trimetallic strip with a copper core, arranged between an active and a passive side, wherein the copper core is partially exposable by removing the active or passive side.

12. The overload release of claim 10, wherein the metal strip in the form of a trimetallic strip includes or embeds copper from the copper core in the surface by virtue of the surface comprising the active or passive side being refused.

13. A circuit breaker, comprising: the overload release of claim 1.

* * * * *